US011499317B2

(12) United States Patent
Carter et al.

(10) Patent No.: US 11,499,317 B2
(45) Date of Patent: Nov. 15, 2022

(54) ROOFING SHINGLE REMOVER

(71) Applicants: David L. Carter, Vermillion, OH (US); Kurt A. Huber, Vermillion, OH (US)

(72) Inventors: David L. Carter, Vermillion, OH (US); Kurt A. Huber, Vermillion, OH (US)

( * ) Notice: Subject to any disclaimer, the term of this patent is extended or adjusted under 35 U.S.C. 154(b) by 714 days.

(21) Appl. No.: 16/421,056

(22) Filed: May 23, 2019

(65) Prior Publication Data

US 2019/0360211 A1 Nov. 28, 2019

Related U.S. Application Data

(60) Provisional application No. 62/675,535, filed on May 23, 2018.

(51) Int. Cl.
*E04D 15/00* (2006.01)

(52) U.S. Cl.
CPC ..... *E04D 15/003* (2013.01)

(58) Field of Classification Search
CPC ..... E04D 15/003; E04D 15/02
USPC ..... 81/45; 52/749.12
See application file for complete search history.

(56) References Cited

U.S. PATENT DOCUMENTS 4,091,535 A * 5/1978 Lehrter ..... E04D 15/003 15/93.1
4,699,430 A * 10/1987 Nichols ..... E04D 15/003 15/93.1
4,763,547 A * 8/1988 Dike, Jr. ..... E04D 15/003 30/169
4,837,933 A * 6/1989 Chapman ..... E04G 23/006 299/37.1
4,858,503 A * 8/1989 Dike, Jr. ..... E04D 15/003 30/169
4,880,491 A * 11/1989 Jacobs ..... E04G 23/02 156/763
5,076,119 A * 12/1991 Wenz ..... E04D 15/003 81/46
5,218,766 A * 6/1993 Himebaugh ..... E04D 15/003 30/170
5,800,021 A * 9/1998 Derr ..... E04D 15/003 15/93.1
5,863,100 A * 1/1999 Martin ..... E04D 15/003 299/37.1
5,868,053 A * 2/1999 Foltz ..... B26D 1/04 83/13

(Continued)

*Primary Examiner* — James M Ference
(74) *Attorney, Agent, or Firm* — Ulmer & Berne LLP

(57) ABSTRACT

A shingle remover includes a fork riser, a pusher, and front and rear crank shafts. The fork riser includes forks separated by fork spacers. The forks are configured to push under shingles and separate them from roof structures. The fork spacers and forks pull out the nails associated with the shingles. Scoops on some of the forks urge pulled shingles away from the shingle remover for disposal. A fork carrier associated with the fork riser secures the forks to a front crank shaft while a cam associated with the front crank shaft periodically urges the forks forward under the shingles. A slot in the fork carrier engages with the rear crank shaft to limit movement of the forks to a substantially horizontal back-and-forth direction. The pusher includes tines that bite into the roof to oppose movement of the shingle remover as the forks push under and remove the shingles.

7 Claims, 6 Drawing Sheets

(56) References Cited

U.S. PATENT DOCUMENTS 5,921,155 A * 7/1999 Faller ..... E04D 15/003 299/36.1
6,095,015 A * 8/2000 Phelan ..... E04D 15/003 81/46
6,116,117 A * 9/2000 Nicolosi ..... E04D 15/003 81/45
6,393,948 B1 * 5/2002 Hutchins ..... E04G 23/006 30/170
6,711,971 B1 * 3/2004 Morin ..... E04D 15/003 81/46
7,013,758 B1 * 3/2006 Gendron ..... E04D 15/003 301/70
7,127,968 B1 * 10/2006 Kriegar ..... E04D 15/003 81/46
7,252,021 B1 * 8/2007 Linscott ..... E04D 15/003 299/36.1
7,318,364 B1 * 1/2008 Nickolas ..... E04D 15/003 299/37.1
7,373,859 B1 * 5/2008 Shirlin ..... E04D 15/003 30/170
7,685,909 B1 * 3/2010 Jones ..... E04D 15/003 81/45
7,802,854 B1 * 9/2010 Lane ..... E04D 15/02 299/39.2
8,056,444 B1 * 11/2011 Van Straten ..... E04D 15/003 299/37.1
8,083,166 B2 * 12/2011 Gould ..... B02C 23/08 241/222
8,650,989 B1 * 2/2014 Bremer, Jr. ..... E04D 15/003 30/170
2006/0117910 A1 * 6/2006 Gendron ..... E04D 15/003 81/45
2006/0156866 A1 * 7/2006 Ingell ..... E04D 15/003 81/45
2006/0179790 A1 * 8/2006 Bremer, Jr. ..... E04D 15/003 52/749.12
2006/0191378 A1 * 8/2006 Linscott ..... E04D 15/003 81/45
2007/0000354 A1 * 1/2007 Tyler ..... E04D 15/003 81/45
2007/0186728 A1 * 8/2007 Willis ..... E04D 15/003 81/45
2008/0223178 A1 * 9/2008 Creato ..... E04D 15/003 52/748.1
2009/0188350 A1 * 7/2009 Becoat ..... E04D 15/003 81/45
2009/0199508 A1 * 8/2009 Fairris ..... E04D 15/003 52/749.12
2010/0212459 A1 * 8/2010 Gould ..... B02C 18/2216 241/101.74
2010/0213295 A1 * 8/2010 Gould ..... B02C 18/2291 241/25
2011/0030511 A1 * 2/2011 Schmidt ..... E04D 15/003 30/170
2011/0192256 A1 * 8/2011 Sparks ..... E04D 15/003 30/272.1
2012/0096990 A1 * 4/2012 Clifford ..... E04D 15/003 29/426.5
2014/0305263 A1 * 10/2014 Berrian ..... E04D 15/003 81/45
2016/0138271 A1 * 5/2016 McAfee ..... E04G 23/006 30/169
2017/0009458 A1 * 1/2017 Underhill ..... E04D 15/003
2019/0360211 A1 * 11/2019 Carter ..... E04D 15/003

* cited by examiner

RIGHT SIDE VIEW

TOP VIEW

LEFT SIDE VIEW

ROOFING SHINGLE REMOVER

CROSS-REFERENCE TO RELATED APPLICATIONS

This application claims the benefit of U.S. Provisional No. 62/675,535, filed May 23, 2018, which is herein incorporated by reference in its entirety.

TECHNICAL FIELD

The subject application generally relates to a shingle removing apparatus and, more specifically, to a portable device configured to remove shingles and nails from roofing structures.

SUMMARY

In an example embodiment, a shingle remover includes a fork riser assembly that includes a number of forks that are configured to push under roofing shingles and separate the roofing shingles from a roof structure such as plywood. The shingle remover also includes a number of tines that are configured to substantially keep the shingle remover in place when the forks are pushing under the roofing shingles.

In another example embodiment, an apparatus includes a plurality of forks that are configured to remove shingles from a roof and plurality of tines that are configured to engage the roof to substantially keep the shingle remover in place as the forks remove the shingles from the roof.

In yet another example embodiment, a roof shingle remover includes a fort riser assembly having a plurality of forks that is configured to push under and separate roof shingles from a roof. The roof shingle remover also includes a pusher assembly that has a plurality of tines that are configured to substantially oppose movement of the roof shingle remover backward as the forks are pushed forward under the shingles. The roof shingle remover also includes a front crank shaft that has a cam. The front crank shaft and cam is associated with the fork riser assembly. The front crank shaft and cam are configured to urge the fork riser assembly forward to push the forks under the shingles. The roof shingle remover also includes a rear crank shaft that has a cam. The rear crank shaft and cam are associated with the pusher assembly. The rear crank shaft and cam are configured to urge the tines against the roof to oppose the movement of the roof shingle remover. The fork riser assembly also includes a fork carrier that secures the fork riser assembly to the front crank shaft and cam via a bearing. The fork carrier is configured to accept the rear crank shaft within a fork slot or u-shaped aperture which limits the movement of the forks to a substantially horizontal direction.

BACKGROUND

Various roofing materials can be used to seal a roof of a home or business from the elements. In many climates, layers of overlapping shingle materials weatherproof roofs from rain or snow. However, shingles can be damaged by strong storms and hail. Shingles can also wear over time and must be periodically replaced every twenty years or so.

Replacing shingles on roofs is labor intensive. Generally the old shingles need to be removed first before a new set of shingles can be installed. Removing the old shingles takes considerable time and effort by laborers. Depending upon the size of the roof and the number of available laborers, removing the old shingles can take half a day or more of a typical two-to-three day roofing job.

Removing the old shingles is difficult because often the nails, or other retainers, are not visible and cannot be easily removed prior to pulling off a shingle. As a result, to remove a shingle the laborer forcefully pulls up on an old shingle with the nails still intact. Not only does this make removal of old shingles more difficult, but old shingles are often brittle. Pulling the shingle up with the nails still intact can cause the shingle to break into multiple pieces during removal, which slows down their removal and makes disposal from the rooftop even more labor intensive. Because shingles overlap one another, an upper shingle must first be removed to fully expose a lower shingle before a lower shingle can be removed. After a shingle is removed, the laborer must remove each of the old nails left in the roof by hand using the claw end of a hammer or a similar tool. Before being removed, old nails left in the roof can present a potential hazard to the laborers. Laborers can easily injure themselves by inadvertently stepping on nails. Nails can also cause a laborer to stumble and potentially fall from a rooftop.

BRIEF DESCRIPTION OF THE DRAWINGS

Various embodiments will become better understood with regard to the following description, appended claims, and accompanying drawings.

DETAILED DESCRIPTION

The systems and methods disclosed herein are described in detail by way of examples and with reference to FIGS. 1 to 4B. It will be appreciated that modifications to disclosed and described examples, arrangements, configurations, components, elements, apparatuses, devices methods, systems, etc. can suitably be made and may be desired for a specific application. In this disclosure, any identification of specific techniques, arrangements, etc. are either related to a specific example presented or are merely a general description of such a technique, arrangement, etc. Identifications of specific details or examples are not intended to be, and should not be, construed as mandatory or limiting unless specifically designated as such.

The systems and methods disclosed herein describe various apparatuses that can be used to remove shingles and nails from rooftops. The disclosed roofing shingle remover advantageously removes both shingles and nails from rooftops at the same time. The shingle remover is a powered device that allows shingles to be removed without first removing an overlapping shingle. This advantageously allows a user to remove shingles at virtually any angle and starting at any suitable location on the roof, without first removing a top set of shingles before progressively removing lower shingles. In operation, a set of tines at the back end secure the shingle remover to the roof and prevent backward motion, while a set of forks at the front end are urged forward under the shingles to remove both the shingles and the nails or staples securing the shingles to the roof. The shingle remover advantageously allows shingles to be quickly removed by a single person, substantially reducing both the amount of time and the amount of labor required to remove the shingles.

Figure 1A:
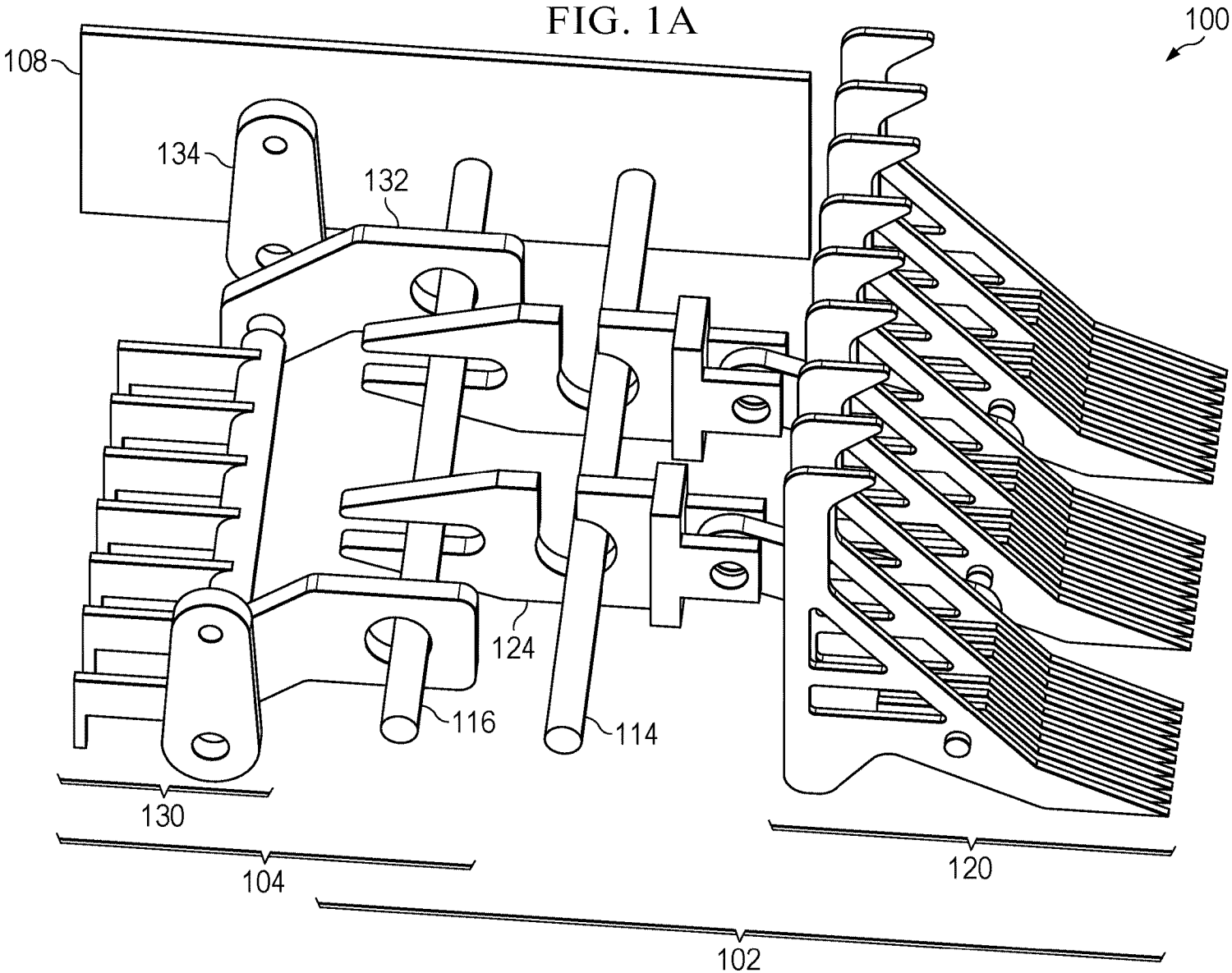
FIG. 1A depicts a partial perspective view of an embodiment of a roofing shingle remover.

Referring now to FIGS. 1A-1D, an example embodiment of a shingle remover 100 is presented. Referring to FIG. 1A, a front end 102 of the shingle remover 100 includes a fork riser assembly 120 configured to push up shingles from a roof and remove nails. A back end 104 of the shingle remover 100 includes a pusher assembly 130 configured to prevent the shingle remover 100 from sliding backwards as the fork riser assembly 120 is urged forward to remove the shingles. The pusher assembly 130 also slowly advances the shingle remover 100 forward on the roof as shingles are removed. A housing 108 can cover portions of the shingle remover 100 can be of any suitable size, shape, and design to cover the various internal mechanisms of the shingle remover 100. The housing 108 be constructed of aluminum, sheet metal, or a plastic to reduce weight.

Figure 1D:
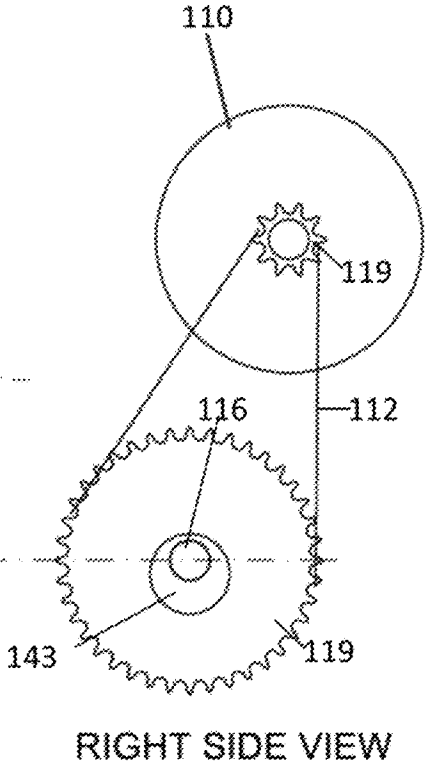
FIG. 1D depicts a right side view of rotating mechanisms of an embodiment of a roofing shingle remover.
Figure 1B:
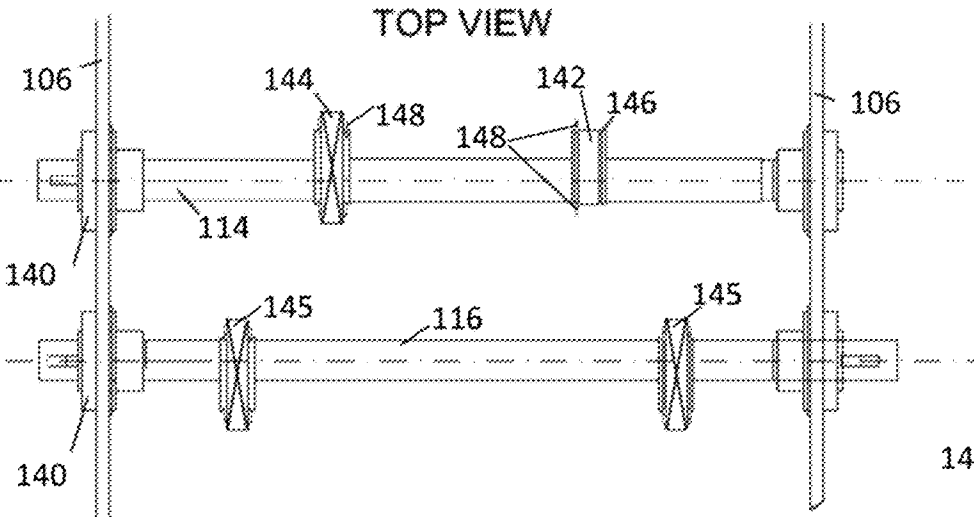
FIG. 1B depicts a top view of rotating mechanisms of an embodiment of a roofing shingle remover.

Referring also to FIG. 1B, the shingle remover 100 includes mechanisms configured to move the front end 102 and back end 104 relative to one another, for example motors, drive chains or gears, crank shafts and so forth. A motor 110, a front crank shaft 114, and a rear crank shaft 116, are suitably connected to a drive chain 112, and a roller chain 118 via sprockets 119 as would be understood in the art. The front crank shaft 114 and rear crank shaft are held in place by a chassis 106 via suitable shaft bearings 140. The chassis 106 can be constructed of aluminum or other low weight rigid materials that provide adequate strength and rigidity for mounting various parts of the shingle remover 100 to the chassis 106.

In an embodiment, the motor 110 is an electric motor controlled by a suitable controller. In various configurations, the motor 110 can be a direct current or DC motor, or an alternating current or AC motor as would be appreciated in the art. For example, AC power is typically available on job sites either from the home itself or from a portable generator brought by a contractor. The controller can be configured to convert the AC power to DC for a DC motor or drive an AC motor directly as would be understood in the art. In an alternative embodiment, the motor 110 can be a gas powered motor, however use of a gas powered engine can present additional technical and safety challenges around exposed wooden structures.

Figure 1C:
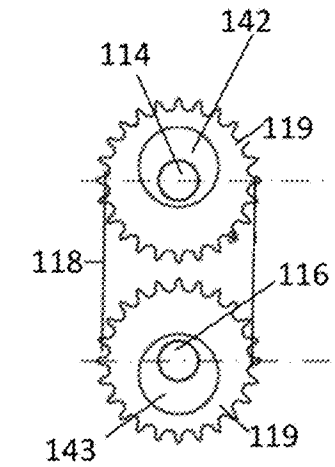
FIG. 1C depicts a left side view of rotating mechanisms of an embodiment of a roofing shingle remover.

Referring now to FIGS. 1C and 1D, in an embodiment the motor 110 drives the rear crank shank 116 via a drive chain 112 and the front crank shaft 114 is connected to the rear crank shaft 116 via a roller chain 118. In alternative embodiments, the front crank shaft 114 and the rear crank shaft 116 can be driven by a single chain, the front crank shaft 114 and the rear crank shaft 116 can be coupled together by a suitable gear mechanism such as a spur gear, or one or more of the front crank shaft 114 or the rear crank shaft 116 can be directly driven by one or more motors 110, among other suitable drive configurations as would be appreciated in the art.

Referring again to FIG. 1B, the front crank shaft 114 includes one or more front cams 142, for example two front cams 142 as shown. The rear crank shaft 116 similarly includes one or more rear cams 143, for example two rear cams 143 as shown. The front crank shaft 114 can be a 0.75 inch diameter shaft with 1.625 inch diameter front cams 142. The front crank shaft 114 can have a journal offset of 0.25 inches relative to the center of the front cams 142. This offset results in the front cams 142 having a total crank throw of 0.50 inches as the front crank shaft 114 and front cams 142 are rotated through 360 degrees.

In an embodiment, for added strength the front crank shaft 114 and front cams 142 can be made from a single piece of steel. In an alternative embodiment, the front cams 142 can be attached to the front crank shaft 114, for example by welding or fasteners as would be understood in the art. In an embodiment, the front bearing 144 can be attached to a front cam 142 using bearing retainers 148, for example Spiro lock rings. For example, as illustrated by the upper right front cam 142, a pair of circumferential channels 146 can be cut into the front cam 142 that are spaced apart approximately the width of the front bearing 144. As illustrated in upper left front cam 142, the front bearing 144 can be placed on the front cam 142 and locked into place using the bearing retainers 148 which are forced into the circumferential channels 146 on either side of the front bearing 144. A suitable rear crank shaft 116 with rear bearings 145 can be constructed similarly to the front crank shaft 114 as described above.

Referring also back to FIG. 1A, the front end 102 and the back end 104 of the shingle remover 100 are in communication with the front crank shaft 114 and the rear crank shaft 116 respectively via the front cams 142 and the rear cams 143. As the crank shafts 114, 116 are turned by the motor 110 via the chains 112, 118, the front cams 142 and the rear cams 143 on the front crank shaft 114 and rear crank shaft 116 respectively cause portions of the front end 102 and back end 104 to move eccentrically. This eccentric motion is translated into substantially back-and-forth motion by the front end 102 and back end 104, such that the front end 102 and the back end 104 are urged in opposite directions, as described in greater detail below. As the crank shafts 114, 116 continue to be rotated, the fork riser assembly 120 is urged under shingles of a roof, while the pusher assembly 130 is urged backwards. As the back end 104 is urged backwards, tines in the pusher assembly 130 grip the roof and the entire shingle remover 100 is urged forward.

Figure 2:
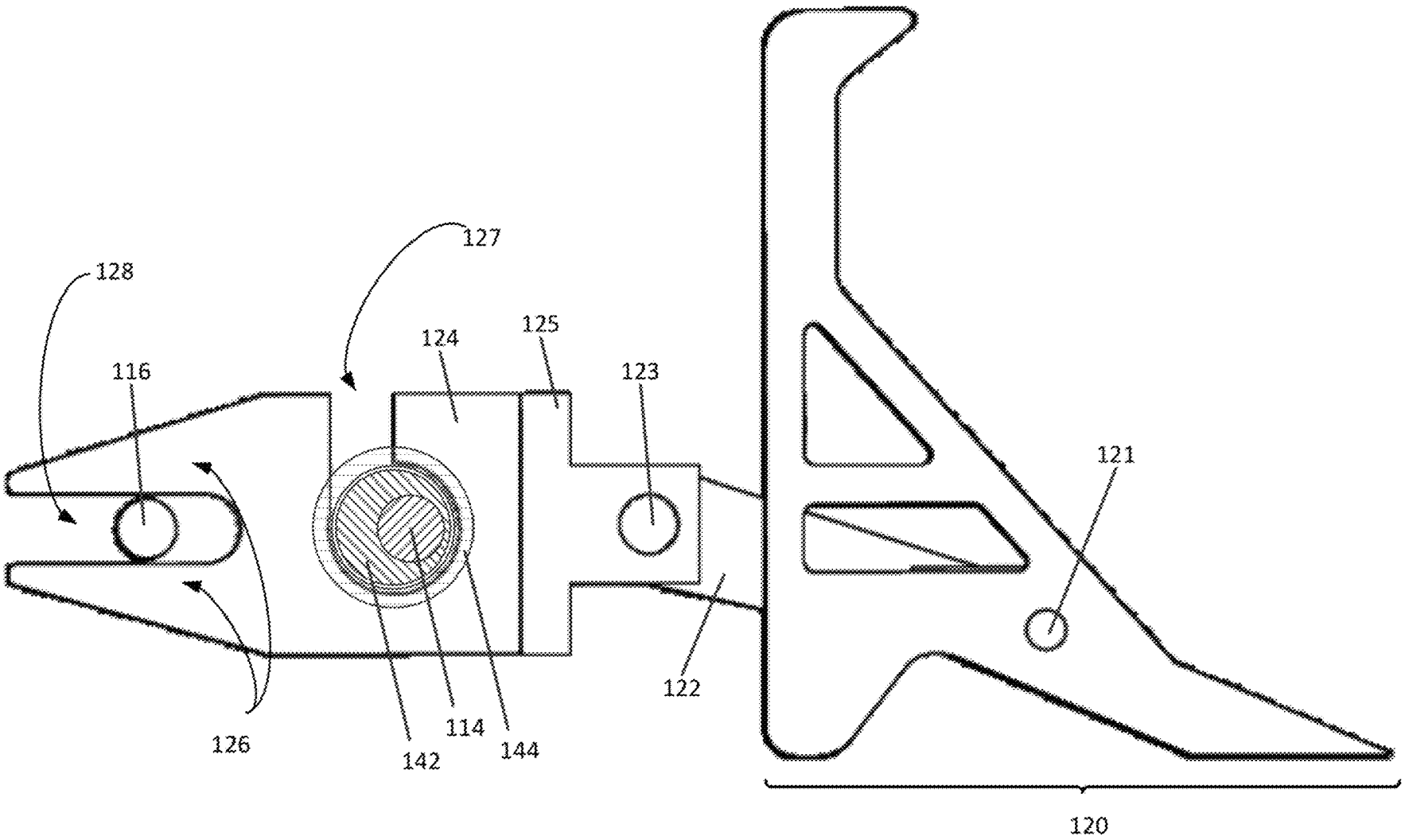
FIG. 2 depicts a side view of an embodiment of a fork riser assembly and front end of a roofing shingle remover.

Referring now to FIG. 2 a side view of an example embodiment of the front end 102 is presented. The front end 102 includes a fork riser assembly 120 that is secured to a fork link 120 via a fork bolt 121. The fork link 122 is coupled to a fork clevis 125 via a link bolt 123. The fork clevis 125 is secured to a fork carrier 124. Fork prongs 126 of the fork carrier 124 create a u-shaped aperture or fork slot 128 between the fork prongs 126 that allow the rear crank shaft 116 to translate back-and-forth inside of the fork slot 128. In embodiments, the back-and-forth horizontal motion can be accomplished with structures other than the rear crank shaft 116 as would be understood in the art. For example, a separate non-moving shaft or bar could be used in place of the rear road crank shaft 116. A front bearing 144 is positioned in an aperture of the fork carrier 124. The front cam 142 of the front crank shaft 114 is rotatably secured in the aperture of the front bearing 144.

The fork carrier 124 can be constructed using two pieces of metal that are joined together to secure the front bearing 144 in place. The front bearing 144 is secured in a cavity between the two pieces of the fork carrier 124. To secure the front bearing 144 in the cavity, the outside diameter of the aperture, or hole, for the front crank shaft 114 is configured to be smaller than the inside diameter of the aperture. While the inside diameter of the aperture is sized to accept the front bearing 144, the outside diameter of the aperture is smaller than the front bearing 144, which prevents the front bearing 144 from leaving the cavity created between the two separate pieces of the fork carrier 124. The two pieces of the fork carrier 124 can be secured together using screws, bolts, or other fasteners as would be understood in the art. Suitable threaded holes in one or both pieces of the fork carrier 124 can be used to secure the fork clevis 125 to the fork carrier 124. A shaft aperture 127 in the fork carrier 124 allows the front end 102 to be removed from the crank shafts 114, 116 for maintenance and repair, and also facilitates assembly of the front end 102 onto the crank shafts 114, 116, without also requiring disassembly of the back end 104 from the rear crank shaft 116.

Figure 3B:
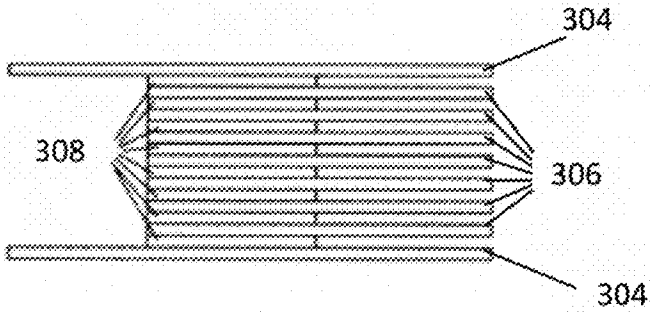
FIG. 3B depicts a top view of the first embodiment of the fork riser assembly.
Figure 3C:
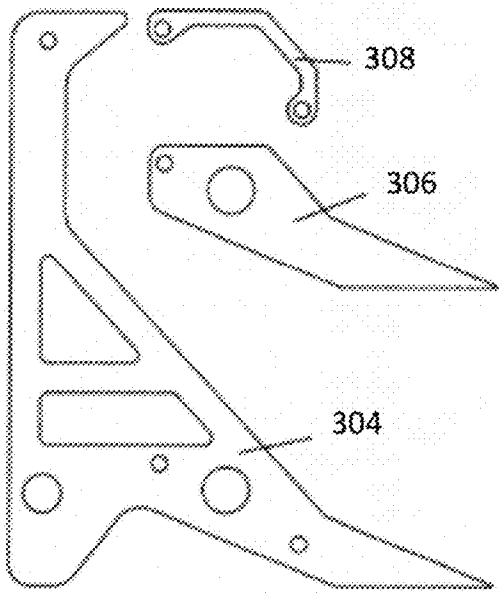
FIG. 3C depicts an exploded view of the first embodiment of the fork riser assembly.
Figure 3A:
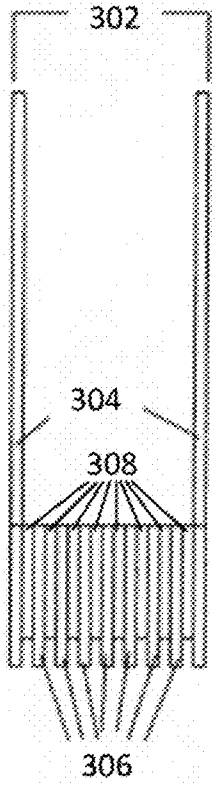
FIG. 3A depicts a front view of a first embodiment of a fork riser assembly.
Figure 3D:
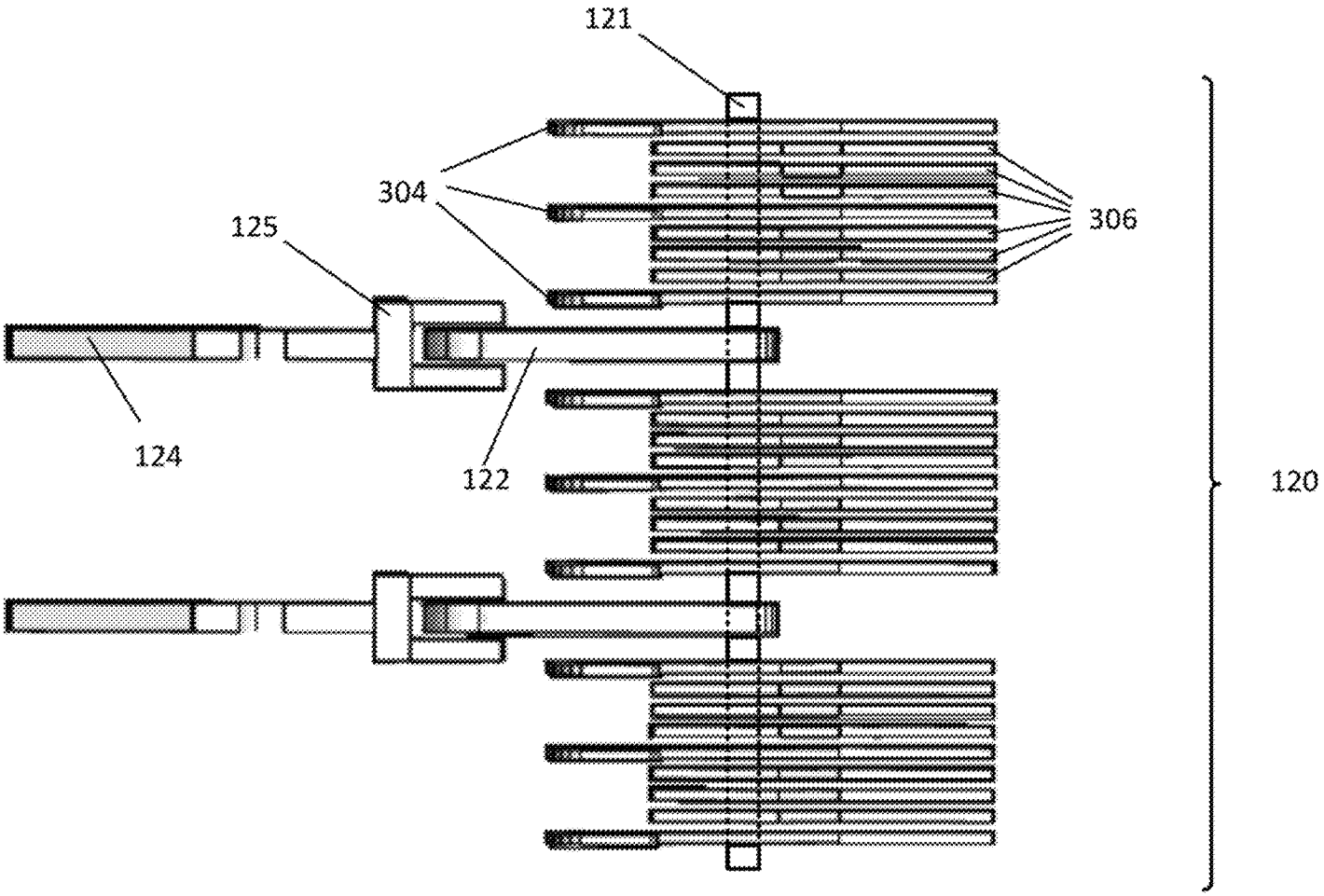
FIG. 3D depicts a top view of a second embodiment of a fork riser assembly.

Referring now also to FIGS. 3A-3D, example embodiments of a fork riser assembly 302 is presented. FIG. 3A illustrates a front view of a fork subassembly 302, while FIGS. 3B and 3C illustrate a top view and an exploded view respectively. FIG. 3D illustrates a fork riser assembly 120 comprising three fork subassemblies 302 having specific configuration of large forks 304 and small forks 306.

Each fork subassembly 302 comprises a plurality of large forks 304, small forks 306, and fork spacers 308. The wedge shape of the large forks 304 and small fork 306 allows the fork riser assembly 120 to get under a shingle and urge the shingle away from the roof. The large forks 304 help to urge the lifted shingle away from the shingle remover 100 and the operator, while the small forks help to reduce the weight of the fork riser assembly 120.

Each of the large forks 304 and small forks 306 is separated by a fork spacer 308. Each of the fork spacers 308 creates a gap between the forks 304, 306. The gap permits the bodies, but not the heads, of nails or staples to pass in between the forks 304, 306. As the fork riser assembly 120 is urged forward under a shingle, the heads of the nails or top of the staples contact the wedge shaped portion of the forks 304, 306 and are urged upwards and removed from the roof. Because the fork riser assembly 120 vibrates, nails and staples that initially hit the end of one of the forks 304, 306 will inevitably work their way into one of the gaps and be removed.

Referring to FIG. 3D, the large forks 304 can spaced periodically with three small forks 306 between each of the large forks 304. The large forks 304, small forks 306, and fork spacers 308 of the fork subassembly 302 are secured to one another by the fork bolt 121, which also secures the fork subassemblies 302 to the fork link 122. As would be understood in the art, different configurations and numbers of large forks 304 and small forks 306 can be used.

Figure 4A:
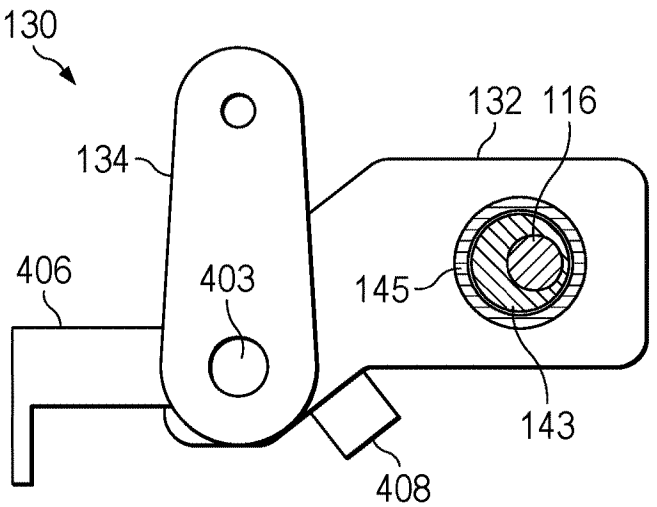
FIG. 4A depicts a side view of an embodiment of a pusher assembly of the roofing shingle remover.
Figure 4B:
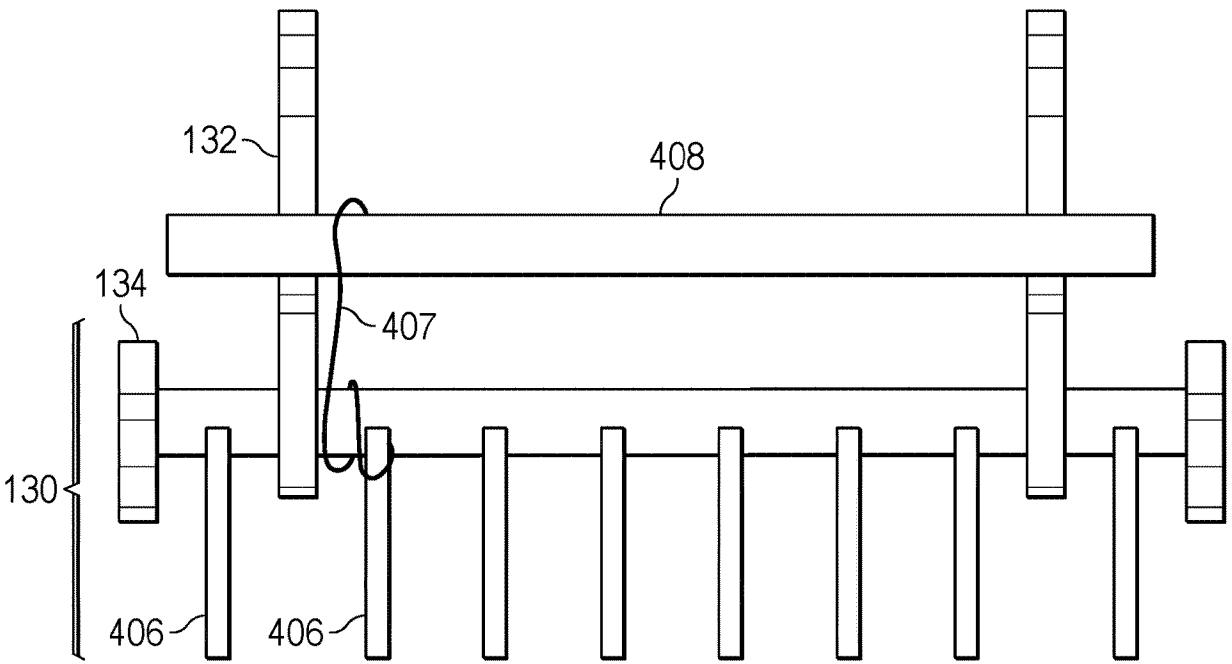
FIG. 4B depicts a top view of an embodiment of the pusher assembly and back end of the roofing shingle remover.

Referring now also to FIGS. 4A and 4B, a side view of a pusher assembly 130 and a top view of pusher assembly 130 and back end 104 are presented respectively. The back end 104 includes the rear carriers 132, side arms 134, biasing bar 408, and pusher assembly 130. The rear crank shaft 116 includes a rear cam 143 and rear bearing 145. The rear carrier 132 is connected to the rear crank shaft 116 via the rear cam 143 and rear bearing 145. The rear carrier 132 is rotatably connected to the side arm 134 and tines 406 via a rear carrier bolt 403. The side arm 134 is rotatably connected to the chassis 108 via a side carrier bolt. When the rear crank shaft 116 is rotated, side arm 134 translates the rotational motion of the rear cam 143 into a generally side-to-side motion at the tines 406. A biasing bar 408 and biasing members, such as biasing springs 407, can be configured to bias the tines 406 to push down against the roof. The biasing springs 407 can also operate to retain the tines 406 at a desired resting position. Each of the tines 406 can rotate independently around the rear carrier bolt 403. This configuration advantageously enables the tines 406 to grip uneven roofs.

Similar to the fork carrier 124 described with regard to FIG. 2, the rear carrier 132 can be constructed using two pieces of metal that are joined together to secure the rear bearing 145 in place. In this configuration, the rear bearing 145 is secured in a cavity between the two pieces of the rear carrier 132. To secure the rear bearing 145 in the cavity, the outside diameter of the aperture, or hole, for the rear crank shaft 116 is configured to be smaller than the inside diameter of the aperture. While the inside diameter of the aperture is sized to accept the rear bearing 145, the outside diameter of the aperture is smaller than the rear bearing 145, which prevents the rear bearing 145 from leaving the cavity created between the two separate pieces of the rear carrier 132. The two pieces of the rear carrier 132 can be secured together using screws, bolts, or other fasteners as would be understood in the art.

The values disclosed herein are not to be understood as being strictly limited to the exact numerical values recited. Instead, unless otherwise specified, each such dimension is intended to mean both the recited value and a functionally equivalent range surrounding that value. It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The foregoing description of embodiments and examples has been presented for purposes of description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent articles by those of ordinary skill in the art. Rather it is hereby intended the scope be defined by the claims appended hereto.

What is claimed is:

1. A shingle remover, comprising:

a fork riser assembly including a plurality of forks configured to push under and separate roofing shingles from a roof structure;

a pusher assembly including a plurality of tines configured to substantially keep the shingle remover in place when the plurality of forks are pushed under the roofing shingles;

a first cam associated with the fork riser assembly and configured to periodically urge the fork riser assembly forward and push under the roofing shingles;

a first crank shaft associated with the first cam;

a second crank shaft associated with a second cam, the second cam being associated with the pusher assembly and configured to lift the plurality of tines away from the roof structure during a first period of rotation of the second crank shaft, and lower the plurality of tines against the roof structure during a second period of rotation of the second crank shaft; and a fork carrier associated with the fork riser assembly and configured to move the fork riser assembly in a substantially lateral direction, wherein the fork carrier is secured to the first crank shaft and the first cam via a bearing, and wherein the fork carrier includes fork prongs configured to limit movement of the fork carrier to the substantially lateral direction.

2. The shingle remover of claim 1, further comprising:

a fork slot between the fork prongs configured to accept the second crank shaft, wherein when the fork carrier is periodically urged forward, the second crank shaft translates in the fork slot to constrain movement of the fork carrier in the substantially lateral direction.

3. The shingle remover of claim 1, wherein the fork carrier includes a shaft aperture associated with the first crank shaft that is configured to allow removal of the fork carrier from the shingle remover.

4. The shingle remover of claim 1, further comprising:

a biasing spring configured to urge the plurality of tines against the roof structure.

5. The shingle remover of claim 1, further comprising:

a motor, wherein one or more of the first crank shaft and the second crank shaft is coupled to the motor.

6. A roof shingle remover, comprising:

a fork riser assembly including a plurality of forks configured to push under and separate roof shingles from a roof;

a pusher assembly including a plurality of tines configured to substantially oppose movement of the roof shingle remover as the plurality of forks are pushed under the shingles;

a front crank shaft and cam associated with the fork riser assembly and configured to urge the fork riser assembly forward and push the plurality of forks under the shingles; and a rear crank shaft and cam associated with the pusher assembly and configured to urge the plurality of tines against the roof to oppose movement of the roof shingle remover, wherein the fork riser assembly further includes a fork carrier that secures the fork riser assembly to the front crank shaft and cam via a bearing, and wherein the fork carrier is configured to accept the rear crank shaft within a fork slot and limit movement of the plurality of forks to a substantially horizontal direction.

7. The roof shingle remover of claim 6, wherein the fork riser assembly further comprises:

a plurality of fork spacers disposed between at least some of the plurality of forks, wherein the plurality of fork spacers and the plurality of forks are configured to pull nails associated with the roof shingles when the plurality of forks are pushed under the roof shingles.

* * * * *